United States Patent [19]

Pearson

[11] Patent Number: 5,054,554

[45] Date of Patent: Oct. 8, 1991

[54] RATE CONTROL METHOD FOR HYDRAULIC FRACTURING

[75] Inventor: C. Mark Pearson, Anchorage, Ak.

[73] Assignee: Atlantic Richfield Company, Los Angeles, Calif.

[21] Appl. No.: 552,404

[22] Filed: Jul. 13, 1990

[51] Int. Cl.[5] ..... E21B 43/267

[52] U.S. Cl. ..... 166/280; 166/308

[58] Field of Search ..... 166/280, 308, 278, 281, 166/283

[56] References Cited

U.S. PATENT DOCUMENTS

| | | | |
|---|---|---|---|
| 3,126,056 | 3/1964 | Harrell | 166/280 |
| 3,127,937 | 4/1964 | McGuire et al. | 166/280 |
| 3,151,678 | 10/1964 | Hanson et al. | 166/280 |
| 3,155,159 | 11/1964 | McGuire, Jr. et al. | 166/280 |
| 3,323,594 | 6/1967 | Huitt et al. | 166/280 |
| 3,664,420 | 5/1972 | Graham et al. | 166/280 |
| 4,245,702 | 1/1981 | Haafkens et al. | 166/280 X |
| 4,378,845 | 4/1983 | Medlin et al. | 166/280 X |

OTHER PUBLICATIONS

Martins, J. P. et al., "Tip Screen-Out Fracturing Applied to the Ravenspurn South Gas Field Development", SPE Paper #19766, Society of Petroleum Engineers, Oct. 8-11, 1989, pp. 595-609.

*Primary Examiner*—Stephen J. Novosad
*Attorney, Agent, or Firm*—Michael E. Martin

[57] ABSTRACT

Hydraulic fracturing of earth formations from wells for producing gas or hydrocarbon liquids is carried out by extending the fracture to a predetermined length with clean or low proppant concentration fluids, then decreasing the rate of injection with low proppant concentration fluids to equal the fluid leakoff rate until the fracture tip is blocked or screened out. Alternatively, the proppant concentration could be progressively increased until tip screenout occurs. Injection rates are then increased, particularly in high permeability formations, to increase the fracture width.

9 Claims, 1 Drawing Sheet

RATE CONTROL METHOD FOR HYDRAULIC FRACTURING

BACKGROUND OF THE INVENTION

1. Field of the Invention

The present invention pertains to an improved method of hydraulic fracturing earth formations to produce fluids therefrom by controlling the rate of injection to form the desired fracture length and fracture width in moderate permeability and high permeability formations.

2. Background

In the hydraulic fracturing of earth formations to stimulate the production of oil and gas from wells, conventional practice results in the injection of fluids into the formation at a rate which is limited by the available pumping power at the well site. A prescribed rate of injection is usually carried out using the available power as the treatment pressure rises to the maximum permitted by such available power.

In earth formations of relatively low permeability, where the production of fluids from the fractured area will be controlled primarily by fracture length, the constant rate of injection method is usually satisfactory. However, in relatively high permeability formations, in which the production of fluids from the fractured zone or area is more a function of fracture conductivity, increased fracture length is not as important or significant as increased fracture width. Accordingly, the present invention is directed to an improved method for controlling the rate of hydraulic fluid injection to provide a fracture which will maximize the production of fluids from earth formations having moderate to high permeability.

SUMMARY OF THE INVENTION

The present invention provides an improved method for hydraulic fracturing an earth formation to stimulate the production of fluids from the formation through a well penetrating the formation. In particular, a fracturing method is provided wherein the rate of fluid injection is such as to control the growth of the fracture by packing proppant into the fracture tip to arrest fracture length increase and then increasing the width of the fracture by injecting higher concentrations of proppant.

In accordance with one important aspect of the present invention, a hydraulic fracture is formed under essentially constant fluid injection rate conditions until the desired fracture length has been obtained using a substantially proppant free or so-called "pad" fluid, followed by the injection of relatively low proppant concentration fluid slurries and decreasing the injection rate to equal the fluid leak off rate from the fracture faces until the fracture tip is packed with proppant or "screened out". Tip "screenout" is the condition wherein the distal end or "tip" of the fracture becomes packed with proppant sufficiently to substantially block the further flow of fracture fluids into the formation at the distal end and thereby prevent further extension of the fracture away from the wellbore. Alternatively, slurries of higher proppant concentration are injected behind the lower proppant concentration slurries until such time as the hydraulic pressure increases due to the fracture tip screenout condition.

In accordance with a further aspect of the present invention, hydraulic fracturing is carried out wherein, upon accomplishing a fracture tip screenout condition, the fluid injection rate is then increased above the fluid leak off rate to create greater fracture width. In this way, a propped fracture of greater fluid conductivity is developed in the formation than if a constant rate of fluid injection is carried out throughout the fracture treatment.

In accordance with still a further aspect of the present invention, a hydraulic fracturing method is provided wherein increased fracture conductivity can be accomplished for gas wells in formations having a permeability above about 0.10 millidarcies and for liquid hydrocarbon producing wells in formations having permeability greater than about 1.0 millidarcies. The methods of the present invention are considered to be more efficient by minimizing the amount of hydraulic fracturing fluid and proppant material used for a given fracture conductivity.

Those skilled in the art will recognize the abovedescribed features and advantages of the present invention together with other superior aspects thereof upon reading the detailed description which follows in conjunction with the drawing.

DESCRIPTION OF A PREFERRED EMBODIMENT

Figure 1:
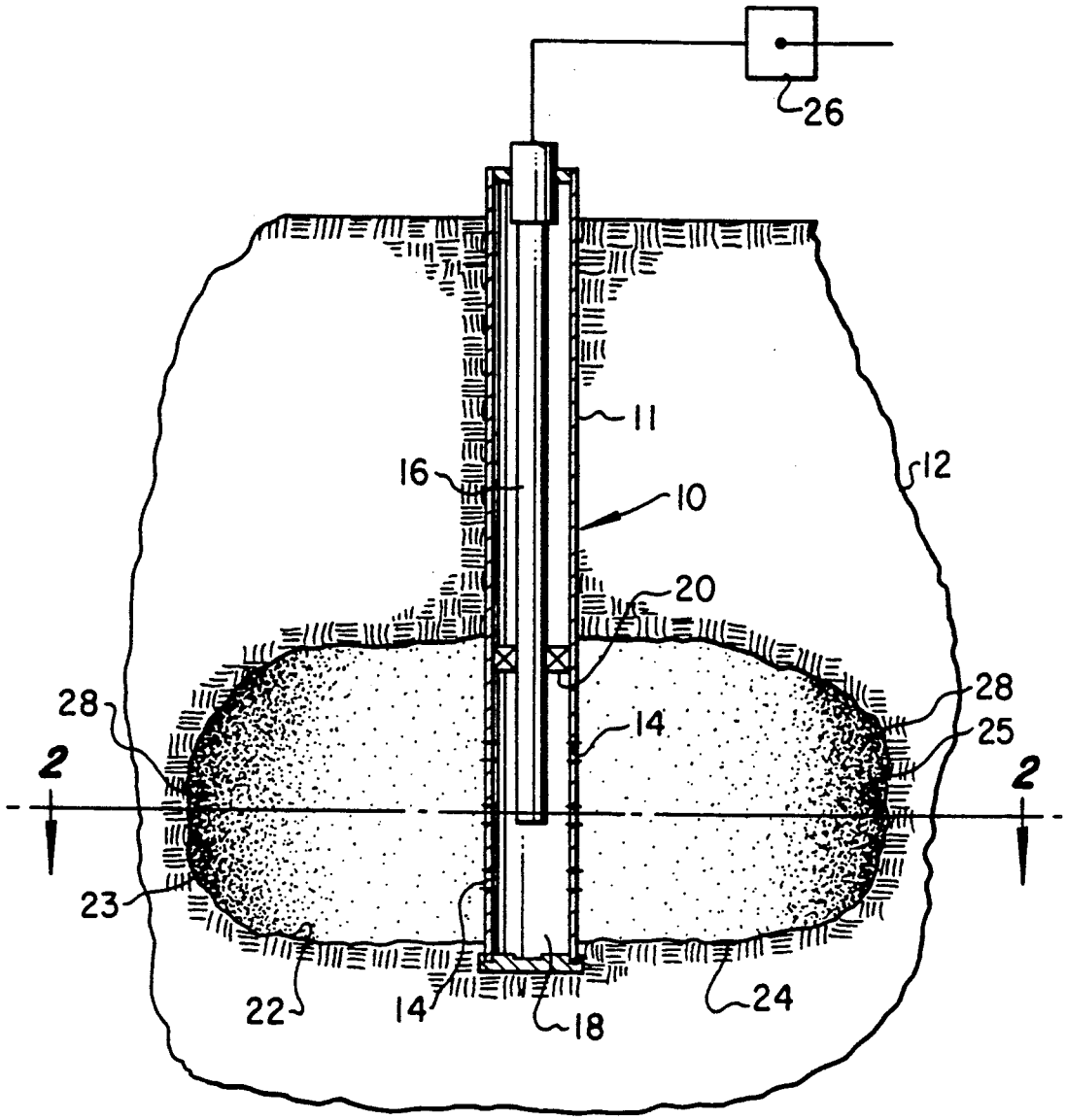
FIG. 1 is a schematic diagram of a typical hydraulic fracture of an earth formation from a well formation.

In the description which follows, like elements are marked throughout the specification and drawing with the same reference numerals, respectively. The drawing figures are in schematic form in the interest of clarity and conciseness.

Figure 2:
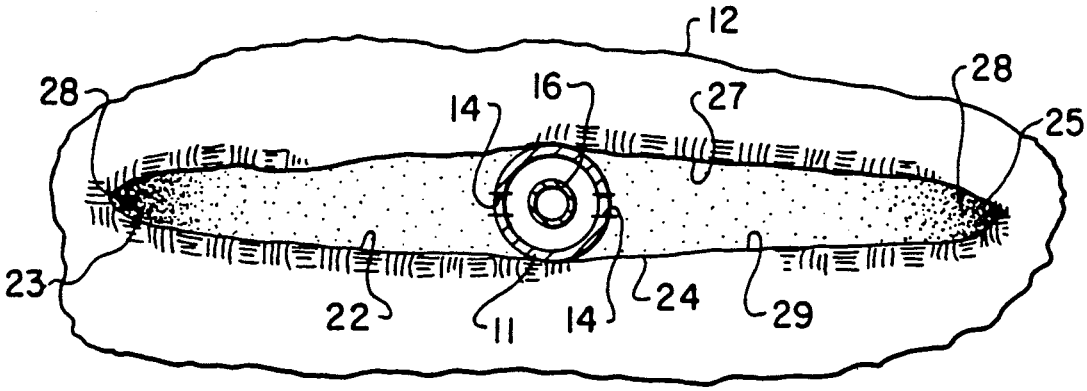
FIG. 2 is a schematic diagram taken along line 2—2 of FIG. 1 showing a fracture which has undergone tip screenout.

FIG. 1 illustrates a typical cased well 10 penetrating an earth formation 12 and perforated at 14 to provide for injection of fluid into the formation by way of a conduit 16 and a space 18 within the well below a packer 20. Fluid flows into the formation through the perforations 14 to usually form a two-winged generally vertically extending fracture designated by numerals 22 and 24. The conduit 16 is connected to a source of pressure fluid, such as a pump 26, which is supplied with fluid which may be a solids free gelatinous substance or may be prepared to have selective concentrations of suitable proppants known to those skilled in the art of hydraulic fracturing of earth formations. A vertical two-winged fracture such as illustrated in FIGS. 1 and 2 is the typical type of fracture encountered in many earth formations. Depending on the orientation of the principal stresses exerted on the earth formation, the fracture may extend in other directions.

FIG. 2 illustrates in somewhat diagrammatic form, and not to scale, a generally horizontal section view of a portion of the formation 12 showing the fracture wing 24 extending from the well casing 11. The fracture wing 24 is shown extended to a tip portion 25 and wherein proppant laden fluid has been injected into the fracture space in such a way that, eventually, proppant 28 is packed in the tip 25 and has blocked the fracture space defining the tip so that further fluid flow into the formation through the tip 25 is substantially precluded. FIG. 1 also shows both fracture wings 22 and 24 packed with proppant 28 at their respective tips or distal ends 23 and 25 to the condition of "screenout". A technical paper prepared for the Society of Petroleum Engineers (SPE) under their number SPE19766 and entitled: "Tip Screen Out Fracturing Applied to the Ravenspurn South Gas Field Development", by J.P. Martins, et al. describes certain aspects of tip screenout fracturing.

By allowing proppant free gel fluid or so-called pad fluid to deplete at the fracture tip portions 23 and 25, fluid injected with proppant therein as a first stage of proppant laden fluid injection will usually result in the screenout condition at the end of the fracture, as illustrated in FIG. 2. This condition usually restricts further growth in the length of the fracture away from the wellbore. As fluid injection continues, the pressure increases and results in increased fracture width or thickness. However, in practice, it is usually difficult or impossible to accurately design the time or fracture length at which this condition will occur. A small error between the design condition and the actual formation leak off rate or a change in the fluid properties will result in either a premature screenout condition with proppant laden fluid left in the wellbore space 18 or a condition in which the screenout does not occur because the pad fluid is never depleted or leaked off sufficiently.

In accordance with the present invention, however, a preferred technique of fracturing, in moderate to relatively high permeability formations, is to initiate the fracture under essentially constant fracture fluid injection rate conditions. Once the desired fracture length is obtained using a substantially proppant free or so-called "pad" fluid, relatively low proppant concentration slurries are then injected into the fracture and the injection rate is decreased to substantially the fluid leakoff rate from the fracture faces, such as the faces 27 and 29, FIG. 2. At this juncture, the injection process may be continued at the decreased rate until proppant is packed into the fracture distal ends or tips and the flow blockage or screenout condition is encountered, as indicated by an increase in the injection pressure.

Alternatively, in high permeability formations, once the desired fracture length is obtained and the injection rate decreased to the leakoff rate, the process may be continued by the injection of fluid containing progressively higher concentrations of proppants until such time as the injection pressure increases due to the tip screenout condition. In the case of relatively high permeability formations, the injection rate is then further increased to create a larger fracture width. Under either condition, that is, fracturing a moderately or relatively low permeability formation or, conversely, a relatively high permeability formation, a propped fracture of greater conductivity is more likely to be formed than if a constant injection rate treatment is carried out.

An example is given below for a formation having a permeability in the range of about 40 millidarcies.

EXAMPLE

The table below gives the treatment schedule for fracturing a well in the Kuparuk River Field, Alaska. The first two stages of injection is gelled water (GW) having a hydroxyl-propyl-guar gellation agent which is used to create the fracture and extend the fracture to the desired length based on conventional calculations and knowledge of formation characteristics. Stage three is conducted at a reduced rate with low proppant concentration (2PPG). Stages four through eight are carried out at a constant rate with progressively greater concentrations of proppant so as to obtain tip screenout and a propped fracture. Units of volume are in barrels (BBLS), pump rates are in barrels per minute (BPM), proppant concentration is in pounds per gallon (PPG) and the proppant is type 12/18M CARBO-LITE, available from Carbo Ceramics, Inc., Dallas, Tx. The last stage of injection is a flushing step using slick diesel fuel.

| STAGE | FLUID DESCRIPTION | CLEAN VOLUME BBLS | PUMP RATE BPM | PROP. CONC. PPG |
|---|---|---|---|---|
| 1 | GW PRE-PAD | 80.0 | 20 | 0 |
| | | 25.0 | 25 | 0 |
| | | 20.0 | 20 | 0 |
| | | 15.0 | 15 | 0 |
| | | 10.0 | 10 | 0 |
| 2 | GW PAD | 300.0 | 20 | 0 |
| 3 | GW w/2 PPG | 55.1 | 8 | 2 |
| 4 | GW w/4 PPG | 25.5 | 20 | 4 |
| 5 | GW w/6 PPG | 31.6 | 20 | 6 |
| 6 | GW w/8 PPG | 37.0 | 20 | 8 |
| 7 | GW w/10 PPG | 41.6 | 20 | 10 |
| 8 | GW w/12 PPG | 26.2 | 20 | 12 |
| 9 | Slick diesel flush | 69.0 | 20 | 0 |

Although preferred embodiments of a fracture treatment process in accordance with the present invention have been described in detail herein, those skilled in the art will recognize that various substitutions and modifications may be made to the methods described without departing from the scope and spirit of the invention as recited in the appended claims.

What is claimed is:

1. A method of forming a fracture in an earth formation, said fracture extending from a wellbore, said fracture being formed for the eventual production of fluids from said formation through the fracture and into the wellbore, said method comprising the steps of:

pumping a liquid into the wellbore at a pressure sufficient to extend a fracture having opposed faces and a tip portion into said formation until a predetermined fracture length is indicated;

injecting a liquid containing a proppant of relatively low concentration and decreasing the rate of injection to a rate approximately equal to the fluid leak off rate from said faces; and injecting liquid containing higher concentrations of proppant than previously mentioned until screenout of said tip portion.

2. The method set forth in claim 1 including the step of:

increasing the rate of injection of proppant laden liquid to a rate in excess of the fluid leakoff rate of said fracture to increase the width of said fracture.

3. The method set forth in claim 1 wherein:

the injection of liquid containing proppants of said higher concentration is carried out by progressively increasing the concentration of proppant until the pumping pressure increases sufficiently to indicate screenout of said tip portion.

4. The method set forth in claim 1 wherein:

the method is performed for producing gas from formations having a permeability greater than 0.10 millidarcies.

5. The method set forth in claim 1 wherein:

the method is performed for producing liquid hydrocarbons from formations having a permeability greater than 1.0 millidarcies.

6. A method of forming a fracture in an earth formation, said fracture extending from a wellbore, said fracture being formed for the eventual production of fluids from said formation through the fracture and into the wellbore, said method comprising the steps of:

injecting liquid into the wellbore at a pressure sufficient to extend a fracture having opposed faces and a tip portion into said formation until a predetermined fracture length is indicated;

injecting a liquid containing a proppant of relatively low concentration into said fracture and decreasing the rate of injection to a rate approximately equal to the fluid leakoff rate from said faces;

injecting liquids into said fracture containing higher concentrations of proppant than previously mentioned until the pumping pressure increases as a result of screening out said tip portion; and increasing the rate of injection of proppant laden liquid for a predetermined time to increase the width of said fracture.

7. The method set forth in claim 7 wherein:

the injection of liquids containing proppants of said higher concentration is carried out by progressively increasing the concentration of proppant until the pumping pressure increases to indicate screening out of said tip portion.

8. The method set forth in claim 6 wherein:

the method is performed in formations having a permeability greater than 0.10 millidarcies.

9. A method of forming a fracture in an earth formation, said fracture extending from a wellbore, said fracture being formed for the eventual production of fluids from said formation through the fracture and into the wellbore, said method comprising the steps of:

injecting a liquid into the wellbore at a pressure sufficient to extend a fracture having opposed faces and a tip portion into said formation until a predetermined fracture length is indicated;

injecting liquid containing a proppant of relatively low concentration and decreasing the rate of injection to a rate approximately equal to the fluid leakoff rate from said faces until proppant is packed into said tip portion and the liquid injection pressure increases to indicate screenout of said tip portion; and increasing the rate of injection of proppant laden liquid to a rate in excess of the fluid leakoff rate of said fracture to increase the width of said fracture.

* * * * *